US008782860B2

(12) United States Patent
Rogers

(10) Patent No.: US 8,782,860 B2
(45) Date of Patent: Jul. 22, 2014

(54) DEVICE FOR SECURING A SHOELACE KNOT

(76) Inventor: Scott Anthony Rogers, Charlotte, NC (US)

( * ) Notice: Subject to any disclaimer, the term of this patent is extended or adjusted under 35 U.S.C. 154(b) by 142 days.

(21) Appl. No.: 13/290,467

(22) Filed: Nov. 7, 2011

(65) Prior Publication Data

US 2013/0111717 A1 May 9, 2013

(51) Int. Cl.
*A43C 7/00* (2006.01)
*A43C 7/04* (2006.01)

(52) U.S. Cl.
CPC .. *A43C 7/005* (2013.01); *A43C 7/04* (2013.01)
USPC ..... 24/712.3; 24/329; 24/335; 24/336; 24/341; 24/487; 24/712.2

(58) Field of Classification Search
USPC ..... 24/712.2, 712.3, 712.6, 712.9, 329, 24/335, 336, 341, 487
See application file for complete search history.

(56) References Cited

U.S. PATENT DOCUMENTS

| | | | | | |
|---|---|---|---|---|---|
| 303,549 | A | * | 8/1884 | Snyder | 24/712.2 |
| 528,464 | A | * | 10/1894 | Craig | 24/712.2 |
| 670,561 | A | * | 3/1901 | Hoegemann | 24/712.6 |
| 675,155 | A | * | 5/1901 | Heiz | 24/712.2 |
| 722,891 | A | * | 3/1903 | Pitman | 24/712.2 |
| 819,884 | A | * | 5/1906 | Higgins | 24/712.6 |
| 895,979 | A | * | 8/1908 | Deiner | 24/707.7 |
| 1,190,724 | A | * | 7/1916 | Chadwick | 24/712.7 |
| 2,699,789 | A | * | 1/1955 | Goodman | 132/278 |
| 2,818,871 | A | * | 1/1958 | Beaudry | 132/278 |
| 3,170,470 | A | * | 2/1965 | Solomon | 132/277 |
| 3,176,362 | A | * | 4/1965 | Tames | 24/712.2 |
| 3,412,739 | A | * | 11/1968 | Thatcher | 132/278 |
| 3,473,198 | A | * | 10/1969 | Meier | 24/712.3 |
| D260,453 | S | * | 9/1981 | Carlson | D11/213 |
| 4,514,882 | A | * | 5/1985 | Lavielle | 24/16 PB |
| 4,715,094 | A | | 12/1987 | Herdsman | |
| 4,805,270 | A | | 2/1989 | Kimbrough | |
| 4,879,787 | A | | 11/1989 | Walls | |
| 4,949,437 | A | | 8/1990 | Anderson | |
| 5,022,127 | A | | 6/1991 | Ang | |
| 5,029,371 | A | | 7/1991 | Rosenblood et al. | |
| 5,062,436 | A | * | 11/1991 | Emsellem | 132/279 |
| 5,372,510 | A | * | 12/1994 | Stanfield | 434/260 |

(Continued)

OTHER PUBLICATIONS

"Clip-Itz Shoelace Clips", located at http://www.innovativethinker.net/clip-itz.html and http://www.innovativethinker.net/howtheywork.html, 4 pages, viewed Nov. 4, 2011.

*Primary Examiner* — Robert J Sandy
*Assistant Examiner* — David Upchurch
(74) *Attorney, Agent, or Firm* — Glenn W. Brown

(57) ABSTRACT

A fastening device is provided for securing a shoelace knot. The fastening device has a base plate configured to conceal a portion of a knot of a tied shoelace, wherein the base plate has an upper surface and a lower surface. The fastening device also has a first clamping assembly arranged on the lower surface of the base plate. The first clamping assembly has an arm moveable between an open position and a closed position. The fastening device also has a second clamping assembly arranged on the lower surface of the base plate. The second clamping assembly has an arm moveable between an open position and a closed position. In addition, the arm of the first clamping assembly and the arm of the second clamping assembly are independently moveable.

20 Claims, 10 Drawing Sheets

(56) References Cited

U.S. PATENT DOCUMENTS

| | | | | |
|---|---|---|---|---|
| 5,649,342 | A * | 7/1997 | D'Andrade et al. | 24/712.2 |
| 5,653,003 | A * | 8/1997 | Freeman | 24/543 |
| 5,718,021 | A * | 2/1998 | Tatum | 24/712.2 |
| 5,894,848 | A * | 4/1999 | Schach | 132/223 |
| 5,913,483 | A * | 6/1999 | Polk | 24/712.3 |
| 5,918,352 | A * | 7/1999 | Galbreath | 24/712.3 |
| 5,937,745 | A * | 8/1999 | Boe | 100/2 |
| 5,979,028 | A | 11/1999 | Hicks et al. | |
| 6,003,522 | A * | 12/1999 | Schach | 132/279 |
| 6,260,246 | B1 | 7/2001 | Lampkins | |
| 6,588,078 | B2 | 7/2003 | Writt et al. | |
| 6,681,779 | B2 * | 1/2004 | Stachowski | 132/279 |
| 6,981,507 | B2 * | 1/2006 | Gabriele-Baumann | 132/275 |
| 7,225,507 | B2 * | 6/2007 | Anderson et al. | 24/329 |
| 7,334,353 | B2 * | 2/2008 | Lampkins | 36/50.1 |
| 7,398,580 | B1 | 7/2008 | Miller, III | |

* cited by examiner

DEVICE FOR SECURING A SHOELACE KNOT

TECHNICAL FIELD

The present disclosure generally relates to fasteners, and more particularly relates to devices for securing shoelace knots.

BACKGROUND

Various types of devices are used to adjust or maintain the tightness of shoes on a person's feet. The most common device, of course, is the shoelace. One problem that arises with shoelaces, however, is that tied laces may have a tendency to become untied, especially when the wearer is physically active or when the laces are not tied properly. Untied shoelaces will often drag along the ground and become tattered and filthy. Also, when shoelaces are untied, the fit of the shoes may become too loose or may be uncomfortable for the wearer. Not only this, but untied shoelaces can also cause a person to trip and fall, causing injury.

SUMMARY

The present disclosure describes various embodiments of fastening devices for securing a knot of a shoelace. The shoelace knot securing device according to some embodiments may be a fastening device that comprises a base plate configured to conceal a knot of a tied shoelace. The shoelace knot securing device also includes a first clamping assembly and a second clamping assembly arranged on a lower surface of the base plate. The first clamping assembly comprises a first arm having a first end and a second end, where the first arm is moveable between an open position and a closed position. The second clamping assembly comprises a second arm having a first end and a second end, where the second arm is moveable between an open position and a closed position. In addition, the arm of the first clamping assembly and the arm of the second clamping assembly are independently moveable.

Various implementations described in the present disclosure may include additional features and advantages, which may not necessarily be expressly disclosed herein but will he apparent to one of ordinary skill in the art upon examination of the following detailed description and accompanying drawings. It is intended that all such features and advantages be included within the present disclosure and protected by the accompanying claims.

BRIEF DESCRIPTION OF THE DRAWINGS

The features and components of the following figures are illustrated, to emphasize the general principles of the present disclosure and are not necessarily drawn to scale. Corresponding features and components throughout the figures may be designated by matching reference characters.

DETAILED DESCRIPTION

Shoelaces that are tied in a knot can sometimes become untied, especially when the wearer is physically active or when the laces are not tied properly. For example, while children are often very active, they may have trouble adequately tying laces such that the laces remain tied. The present disclosure describes fastening devices that are configured to secure a shoelace knot and do so in a stylish and decorative manner. By utilizing the fastening devices described herein, the user's shoelaces can stay tied during physical activity, even when the laces may not necessarily be tied tightly.

Figure 1:
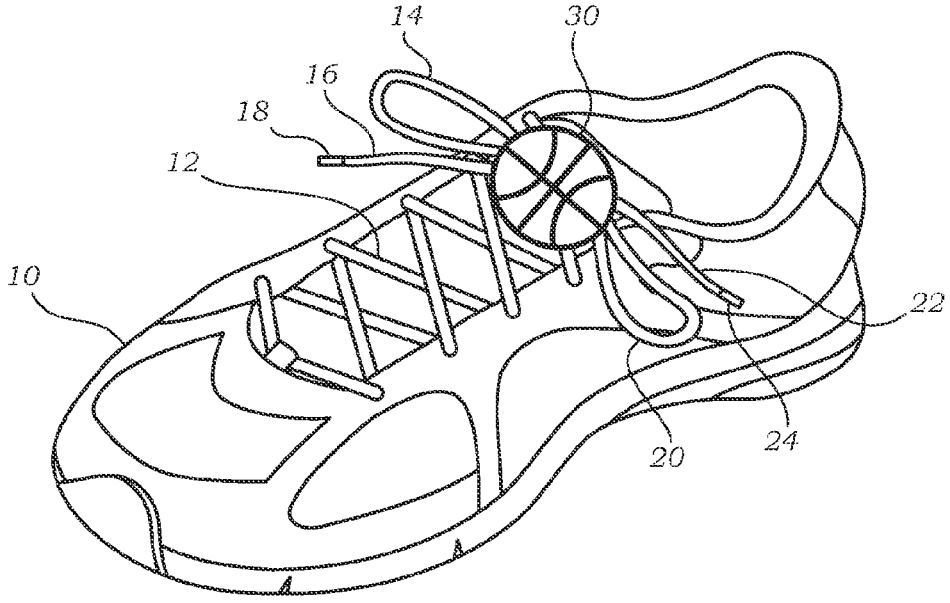
FIG. 1 is a diagram illustrating a shoelace knot securing device, according to various implementations of the present disclosure, fastened on a shoe.

FIG. 1 is a diagram of a shoe 10 having a shoelace 12 that is tied in a conventional manner. Particularly, one side of the knot (not shown) of the shoelace 12 includes a first loop 14, a first free end 16, and a first aglet 18 that is attached to the end of the first free end 16. The other side of the knot of the shoelace 12 includes a second loop 20, a second free end 22, and a second aglet 24 that is attached to the end of the second free end 22.

A shoelace knot securing device 30, according to the embodiments described, in the present disclosure, is configured to secure the knot of the shoelace 12. The shoelace knot securing device 30 includes two damping assemblies, where one clamping assembly is configured to clamp the laces on one side of the knot (e.g., the first loop 14 and first free end 16) and another clamping assembly is configured to clamp the laces on the other side of the knot (e.g., the second loop 20 and second free end 22). The shoelace knot securing device 30 may be secured so as to cover or hide the knot while also holding the loops 14, 20 and free ends 16, 24 of the shoelace 12 in a substantially fixed manner. When the user wishes to untie the knot of the shoelace 12, the user may first unclamp the clamping assemblies from the shoelaces 12 and the shoelace knot securing device 30 may be removed from the shoe 10. The shoelace knot securing device 30 may be configured to secure the knots of the shoelace 12 illustrated in FIG. 1 or the knots of other types or sizes of other laces or strings for any suitable type of shoe, boot, or other footwear that includes one or more shoelaces, shoestrings, or the like.

Figure 2A:
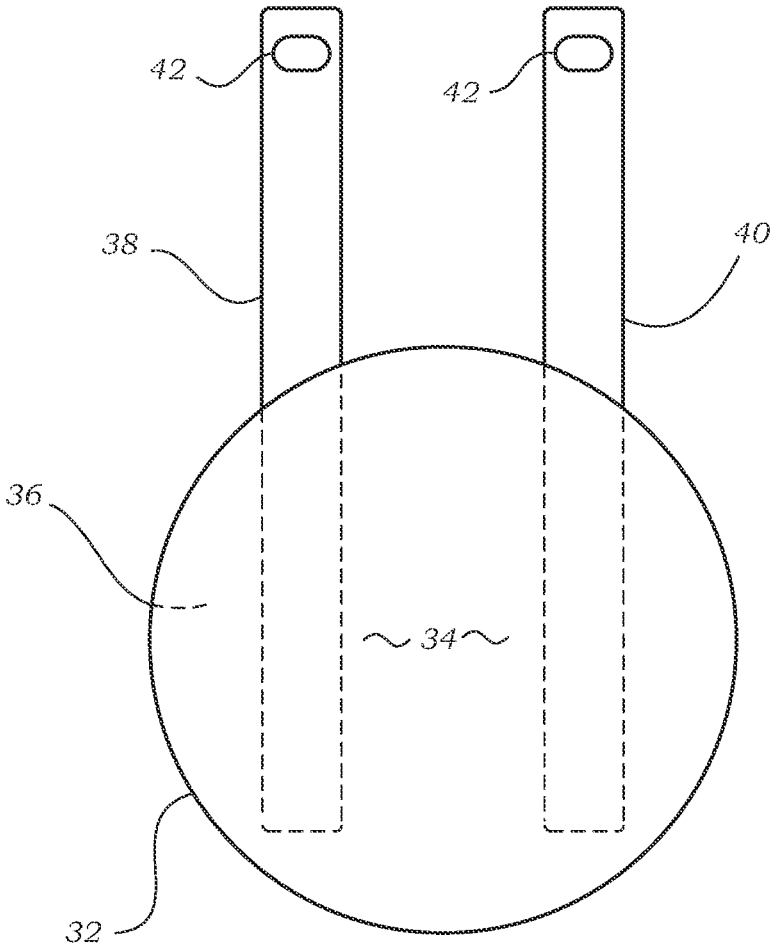
FIGS. 2A-2C are diagrams illustrating top views and a bottom view of a base plate of the shoelace knot securing device shown in FIG. 1, according to various implementations of the present disclosure.
Figure 2B:
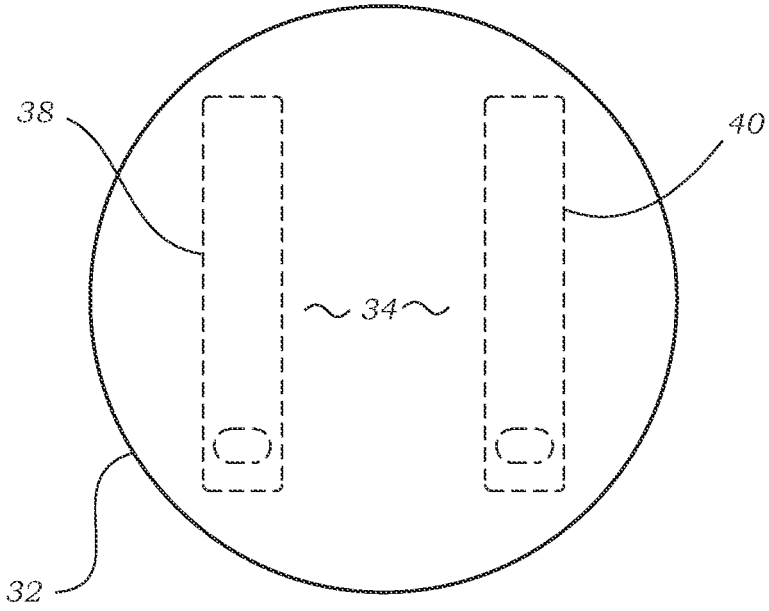
Figure 2C:
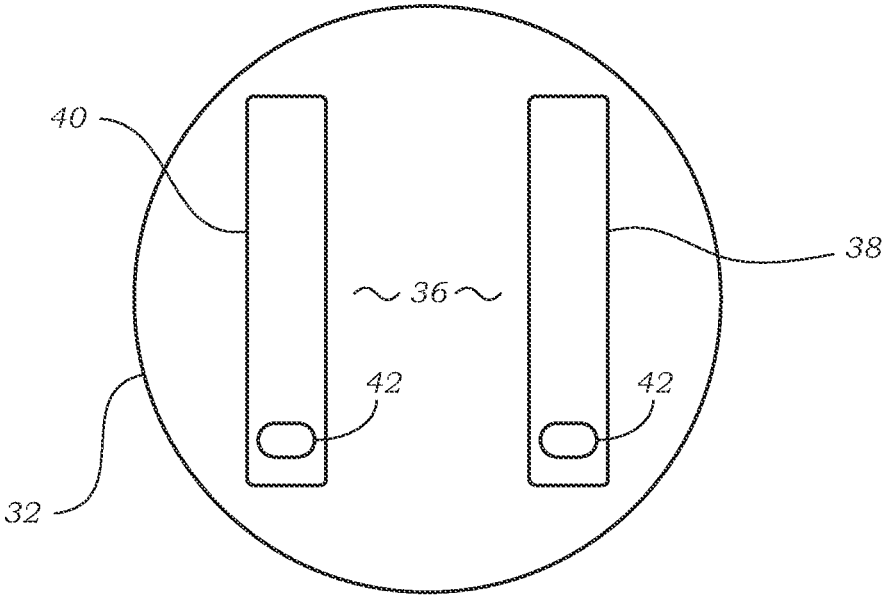

FIGS. 2A-2C are diagrams illustrating an embodiment of a flat base plate 32. For example, the base plate 32 may be part of the shoelace knot securing device 30 shown in FIG. 1 according to some embodiments. The base plate 32 includes a top surface 34 and a bottom surface 36. FIG. 2A illustrates a top view of the top surface 34 of the base plate 32 with clamping assemblies 38 and 40 arranged on the bottom surface 36 in an open position. FIG. 2B illustrates a top view of the top surface 34 of the base plate 32 with the clamping assemblies 38 and 40 arranged in a closed position. FIG. 20 illustrates a bottom view of the bottom surface 36 of the base plate 32 with the clamping assemblies 38 and 40 arranged in a closed position.

In FIG. 2A, the first clamping assembly 38 and second damping assembly 40 are shown partially in phantom and arranged on the bottom surface 36 of the base plate 32. Each clamping assembly 38 and 40 has a hole 42 at its free end, where the hole 42 is configured to be engaged with a corresponding protrusion to lock the clamping assembly 38, 40 in a closed position. In some embodiments, the base plate 32 and clamping assemblies 38 and 40 may be formed as a unitary piece in a single manufacturing process. In stead of the clamping assemblies 38 and 40 being attached to the bottom surface 36 of the base plate, the clamping assemblies 38 and 40 may be configured to extend from a side edge of the base plate 32

In some embodiments, a decorative layer or decorative element may be attached to the top surface 34 of the base plate 32. The base plate 32 may be configured as a circular disk (as illustrated), or may be oval, square, rectangular, or have any other suitable shape. In some embodiments, the base plate 32 may be formed in a shape that matches the shape of a cavity on an underside of the decorative layer, the cavity being configured to receive the base plate 32.

According to various implementations, when configured as a circular disk, the base plate 32 may have a diameter in the range from about 1.375 inches to about 2.000 inches. The thickness of any combination of elements that includes the base plate 32, clamping assembly 38 (or 40), and a decorative element attached to a top surface of the base plate 32, depending on the different embodiments described herein, may be in the range from about 0.125 inches to about 0.250 inches. The length of each of the clamping assemblies 38 and 40, when in the open position, may be in the range from about 2.125 inches to about 2.625 inches. The length of each of the clamping assemblies 38 and 40, when in the closed position, may be in the range from about 1.000 inches to about 1.250 inches. The width of the clamping assemblies 38 and 40 may be in the range from about 0.175 inches to about 0.250 inches. As illustrated, the arms of the clamping assemblies 38 and 40 are arranged in a substantially parallel manner. A distance between the clamping assemblies 38 and 40, when arranged in parallel, may be in the range from about 0.375 inches to about 0.750 inches, depending on various implementations.

The description, below, in many instances, may refer to only one of the clamping assemblies. For the sake of simplicity, reference may be made to the first clamping assembly 38. However, it should be noted that the second clamping assembly 40 may also be configured with the same features and characteristics as those of the first clamping assembly 38, even if only the first clamping assembly 38 is described. According to other embodiments, the first clamping assembly 38 and second clamping assembly 40 may have different configurations or the features of each may be mirrored (or reversed) as compared to the other.

Figure 3:
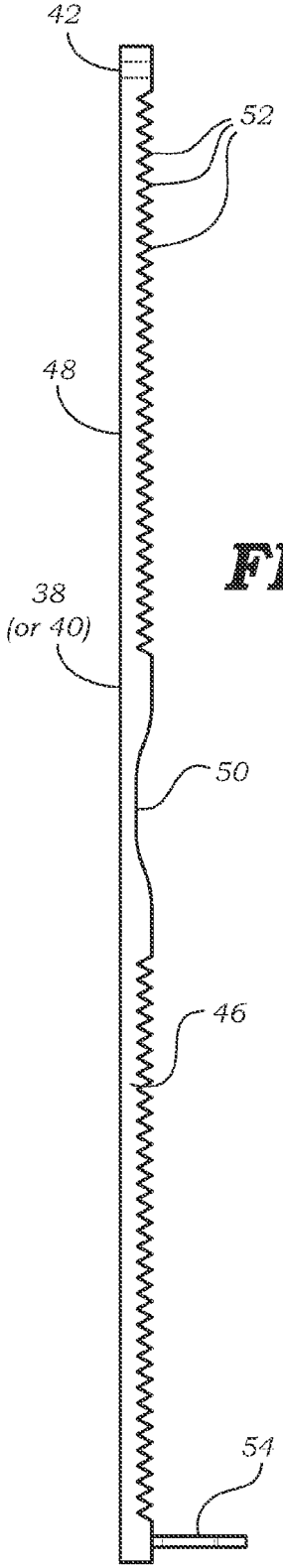
FIG. 3 is a diagram illustrating a side view of a first embodiment of a clamping assembly according to various implementations of the present disclosure.

FIG. 3 is a diagram illustrating a side view of an embodiment of the first clamping assembly 38 (or second clamping assembly 40). In this embodiment, the clamping assembly 38 comprises a first arm 46 and a second arm 48. With respect to embodiments in which the clamping assemblies 38 and 40 are attached to the base plate 32, the first arm. 46 of each of the respective clamping assemblies 38 and 40 is configured to be attached to the bottom surface 36 of the base plate 32, and the second arm 48 is configured to be free to move. According to alternative embodiments, the first arm 46 may be formed integrally with the base plate 32 and may be substantially in the same plane as the base plate 32.

The clamping assembly 38 also includes a joint 50. As shown, the thickness of the joint 50 may be less than the thickness of the arms 46 and 48 to allow the bending of the second arm. 48 with respect to the first arm 46 about a pivotal point of the thinner sections of the joint 50. In some embodiments, the joint 50 may be a living hinge and may comprise a material, such as polypropylene or polyethylene, which allows the joint 50 to be bent hundreds or thousands of times without damaging its integrity.

The clamping assembly 38 may further include multiple ridges or teeth 52 arranged on one side of either or both of the first arm 46 and second arm 48. With respect to embodiments in which the first arm 46 is incorporated in the base plate 32 or is omitted such that the joint 50 and second arm 48 extend from a side edge of the base plate 32, portions of the bottom surface 36 of the base plate 32 may include teeth 52 to correspond with the teeth of second arm 48. When the clamping assembly 38 is arranged in a closed position, the teeth 52 are configured to secure the shoelaces 12 from opposite sides to keep the shoelaces 12 from slipping out of the grasp of the clamping assembly 38.

Furthermore, the clamping assembly 38 includes a lock or latch comprising the combination of a protrusion 54 and the hole 42. The protrusion 54 is configured to be arranged on the first arm 46 at an opposite end from the joint 50. When the second arm 48 is rotated with respect to the first arm 46, the protrusion 54 is configured to be aligned with the hole 42. The protrusion 54 and hole 42 are designed to be complementary to each other and provide a locking function when the protrusion 54 is inserted through the hole 42. To unlock the clamping assembly 38, a person need only provide a small amount of pressure on the end of the second arm 48 away from the first arm 46 to release the protrusion 54 from the hole 42.

Figure 4A:
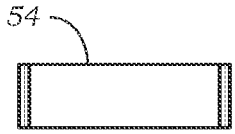
FIGS. 4A-4C are diagrams illustrating a top view, front view, and bottom view, respectively, of a protrusion of the clamping assembly shown in FIG. 3, according to various implementations of the present disclosure.
Figure 4B:
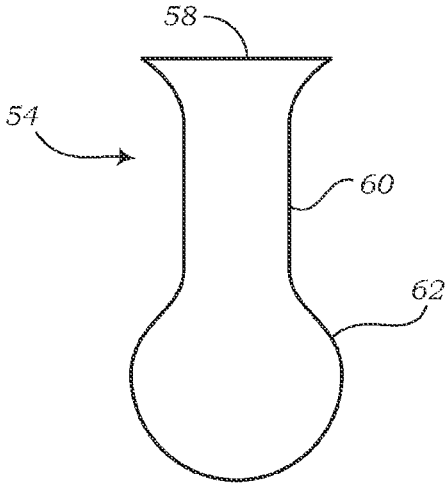
Figure 4C:
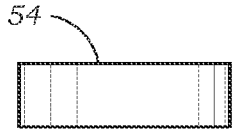

FIGS. 4A-4C illustrate an embodiment of the protrusion 54. FIG. 4A shows a top view of the protrusion 54; FIG. 4B shows a front view of the protrusion 54; and FIG. 4C shows a bottom view of the protrusion 54. As shown, the protrusion 54, according to this embodiment, includes a top surface 58, neck 60, and head 62. The top surface 58 is configured to be attached to a far end of the first arm 46 and extend downward (when the first arm 46 is arranged in a horizontal configuration). During a locking process, the head 62 is the first element of the protrusion 54 that engages the hole 42. The head 62 may have a width that is similar to or slightly larger than the width of the hole 42, requiring a small amount of force to push the head 62 through the hole 42. When locked, the edges of the hole 42 surround portions of the neck 60 and head 62.

Figure 5:
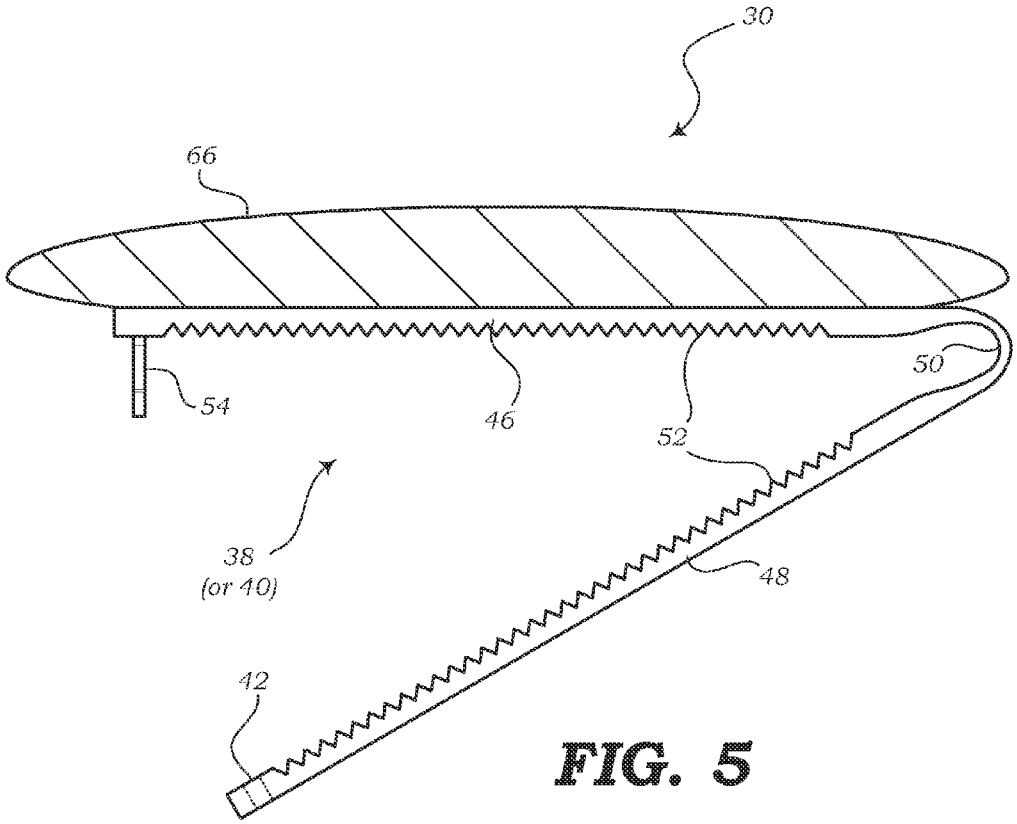
FIG. 5 is a cross-sectional side view of an embodiment of a shoelace knot securing device having the clamping assembly shown in FIG. 3, the clamping assembly being arranged in an open position.

FIG. 5 illustrates a cross-sectional side view of an embodiment of the shoelace knot securing device 30 with the clamping assembly 38 in an open position. For example, when the clamping assembly 38 is in the open position, the user may position the shoelace knot securing device 30 such that the first loop 14 and first free end 16 of the shoelace 12 (FIG. 1) on one side of the knot are placed within the grasp of the first damping assembly 38. Likewise, the second loop 20 and second free end 22 on the other side of the knot are placed within the grasp of the second damping assembly 40. To secure the knot, the protrusion 54 on each damping assembly 38 and 40 is engaged in the respective holes 42.

The shoelace knot securing device 30 may comprise a decorative cap 66, which may be configured to be attached to the top of the shoelace knot securing device 30 and display a decorative image that may be easily seen when the shoelace knot securing device 30 is installed on the shoe 10. In some embodiments, the shoelace knot securing device 30 may comprise the base plate 32 to which the damping assemblies 38 and 40 and decorative cap 66 are attached. However, as illustrated, in accordance with alternative embodiments, the clamping assemblies 38 and 40 may be attached directly to the decorative cap 66. The decorative cap 66 may have a convex profile on its top surface, as shown, or may have any other suitable shape, depending on the size and shape of the decorative design. The decorative cap 66 may also have a cavity on its bottom surface to receive the base plate 32 and/or clamping assemblies 38 and 40. The decorative cap 66 and the base plate 32 may be attached together by an adhesive material, by dips, or by other suitable attachment means.

According to some embodiments, the base plate 32, first clamping assembly 38, and second clamping assembly 40 may be formed as a single unit in one manufacturing process. In this case, the first arm 46 of the clamping assemblies 38, 40 may be omitted and the base plate 32 may be formed with the teeth 52 along the entire bottom surface 36 of the base plate 32 or at locations corresponding to locations opposite from the teeth 52 on the second arms 48 when in the closed position. Also, when the damping assemblies 38. 40 are formed as one piece with the base plate 32, the joint 50 may extend from a side edge of the base plate 32. When the decorative cap 66 is attached to the base plate 32, the joint 50 may be configured such that, when the damping assembly 38, 40 is in the dosed position, the joint 50 may be tucked underneath the decorative cap 66, or, in alternative embodiments, the joint 50 may extend slightly beyond the edge of the decorative cap 66.

Figure 6:
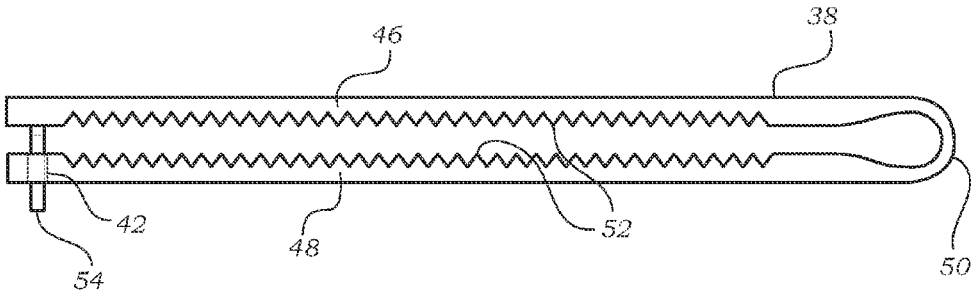
FIG. 6 is a diagram illustrating a side view of the clamping assembly shown in FIG. 3, the clamping assembly being arranged in a closed position.

FIG. 6 illustrates the clamping assembly 38 in a closed position. In the closed position, the joint 50 is able to be bent such that the first arm. 46 and second arm 48 are substantially parallel. As shown, the teeth 52 projecting from the opposing surfaces of the arms 46 and 48 may help to secure a shoelace initially inserted between the damping arms. In this view, the protrusion 54 is inserted, through the hole 42 and held in place by the edges of the hole 42 around the neck 60 of the protrusion 54 and portions of the head 62 supported against, the edges of the hole 42.

The embodiments of the clamping assembly 38 shown in FIGS. 3, 5, and 6 are configured such that the protrusion 54 is attached to the first arm 46 and the hole 42 is formed in the end of the second arm 48, thereby forming a locking element. However, according to alternative embodiments, the protrusion 54 may be attached to the second arm 46 and designed to be inserted through a hole formed in the first arm 46 and base plate 32. Other types of locking mechanisms may also be used for locking the arms 46 and 48 in a closed (i.e., clamping) position.

Figure 7:
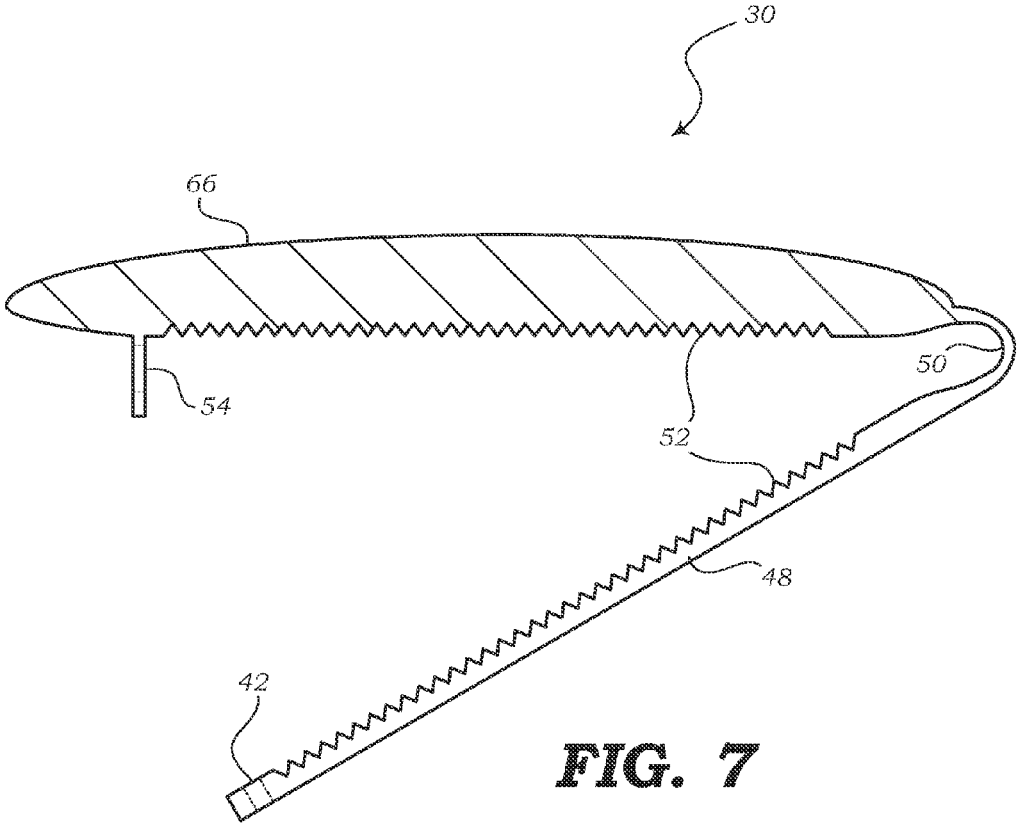
FIG. 7 is a diagram illustrating a cross-sectional side view of another embodiment of a shoelace knot securing device, according to various implementations of the present disclosure.

FIG. 7 illustrates a cross-sectional side view of the decorative cap 66 according to another embodiment. In this embodiment, the base plate 32 and first arm 46 are omitted and the joint 50 is formed at the edge of the decorative cap 66. Also, portions of a bottom surface of the decorative cap 66 may comprise teeth and the protrusion 54.

Figure 8A:
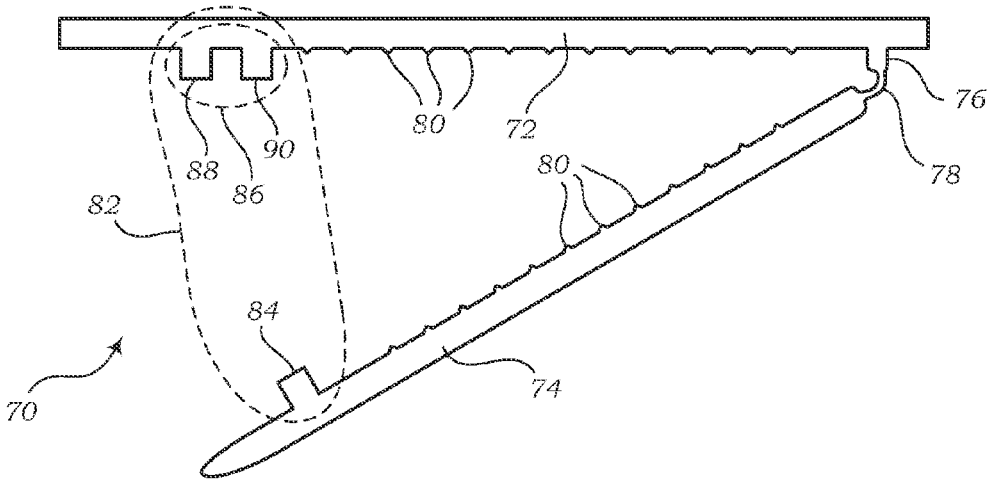
FIG. 8A is a diagram illustrating a side view of a second embodiment of a clamping assembly, according to various implementations of the present disclosure, the clamping assembly being arranged in an open position.
Figure 8B:
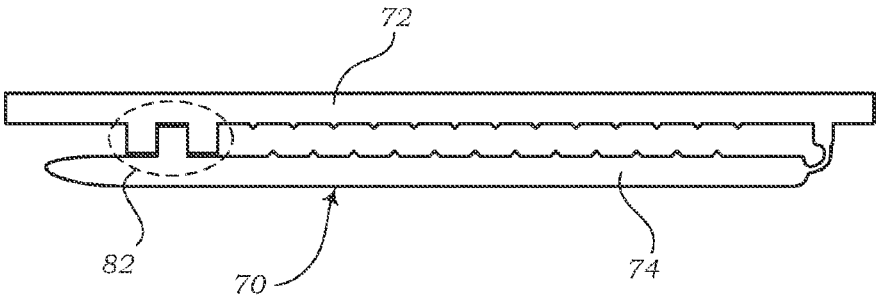
FIG. 8B is a diagram illustrating the clamping assembly of FIG. 8A, arranged in a closed position.

FIGS. 8A and 8B illustrate a second embodiment of a clamping assembly 70. FIG. 8A shows the clamping assembly 70 in an open position and FIG. 8B shows the clamping assembly 70 in a closed position. As described with respect to the clamping assemblies 38 and 40, a second damping assembly (not shown) may be paired with clamping assembly 70 such that the two clamping assemblies can be clamped to the shoelaces 12 on opposite sides of the knot.

In some embodiments, the clamping assembly 70 may include a first arm 72 and a second arm 74. The first arm 72 is configured to be attached by any suitable means to the base plate 32 or may be incorporated with the base plate 32. The clamping assembly 70 also includes a stub 76 and a flexible hinge 78. The stub 76 is formed on a lower surface of the first arm 72 and is configured to provide a support structure for the flexible hinge 78. Also, the stub 76 is designed to create a gap between the first arm 72 and the second arm 74. In some embodiments, the flexible hinge 78 may be a living hinge and may comprise a material, such as polypropylene or polyethylene, which allows the flexible hinge 78 to be bent hundreds or thousands of times without damaging its integrity.

The first arm 72 of the damping assembly 70 includes a top surface that is configured to be attached to the lower surface 36 of the base plate 32 or a lower surface of the decorative cap 66. A plurality of ridges 80 may be formed on a bottom surface of the first arm 72 and on an upper surface of the second arm 74. The ridges 80 are configured to help prevent a shoelace from slipping out of the grasp of the clamping assembly 70. Not only can the arms 72 and 74 provide a pinching force on a shoelace, but also the ridges 80 can provide additional holding force.

In some embodiments, the ridges 80 on the different arms may be aligned opposite of each other to allow the clamped shoelace to be pinched from opposite directions. In other embodiments, the ridges 80 may be arranged in an offset manner. Alternatively, the ridges 80 may be arranged at any suitable angle across the width of the arms 72 and 74. For example, the ridges 80 may he formed such that one set of ridges is transverse to the other set of ridges. Instead of ridges 80, according to some embodiments, the first arm 72 and second arm 74 may include bumps, waves, or other textured surface configurations to provide an additional level of friction with the shoelace.

The clamping assembly 70 further comprises a latch 82. The latch 82 is configured to keep the second arm. 74 of the clamping assembly 70 in the closed position, until the wearer wishes to remove the shoelace knot securing device 30. The latch 82 comprises a protrusion 84 and a catch 86. As illustrated, the protrusion 84 is formed on the second arm 74 and the catch 86 is formed on the first arm 72. Alternatively, the protrusion 84 may be formed on the first arm 72 and the catch 86 may be formed on the second arm 74. As shown, the catch 86 comprises a first wail 88 and second wall 90. When a force is applied, to pivot the second arm 74 toward the first arm 72, the catch 86 is configured to receive and hold the protrusion 84. The protrusion 84 may be configured with a width that is approximately equal to the gap between the first wall 88 and second wall 90. To release the protrusion 84 from the catch 86, opposing forces are applied to the second arm 74 and first arm. 72, causing the protrusion 84 to pull out from the hold of the first and second walls 88 and 90.

As illustrated, the protrusion 84 extends from the top surface of the second arm 74 at the opposite end of the arm 74 from the hinge 78. The protrusion 84 is configured to extend in a substantially perpendicular direction from the second arm 74 to allow the protrusion 84 to align with and easily enter the gap between the first wall 88 and second wail 90. The outer surfaces of the protrusion 84 contact the inner surfaces of walls 88, 90 to hold the arm 74 in the closed position. To overcome the frictional force between these surfaces, a sufficient force is needed to remove the protrusion 84 from the catch 86.

When the clamping assembly 70 is in a closed position, as illustrated in FIG. 8B, the latch 82 is configured to be secured and the second arm 74 is arranged substantially parallel with the first arm 72. The clamping assembly 70 may be constructed such that a gap between the first and second arms 72 and 74, when in the closed position, has a dimension in the range from about 0.060 inches to about 0.125 inches. In use, the shoelace 12 would be held by the clamping assembly 70 when the second arm 74 is in the closed position.

Figure 9:
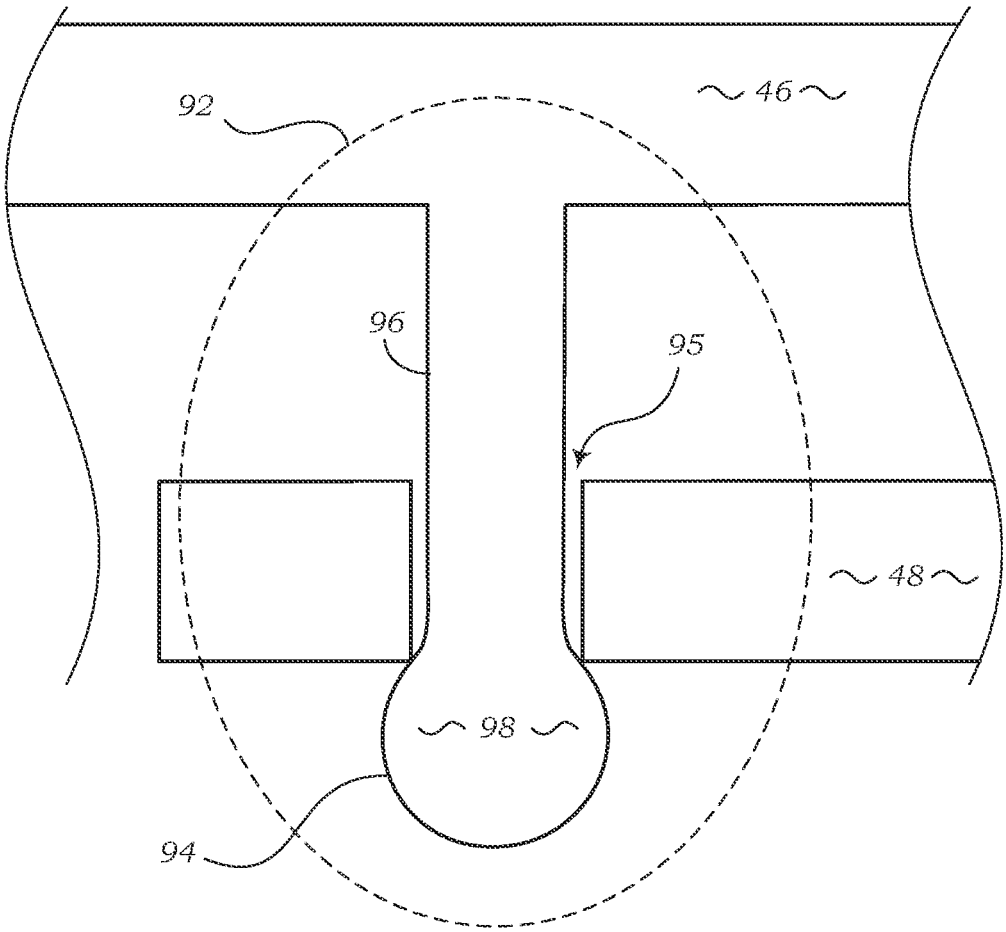
FIG. 9 is a side view of a first embodiment of a latch of the clamping assembly of FIG. 3, according to various implementations of the present disclosure.

FIG. 9 is a side view showing another embodiment of a latch 92 of the clamping assembly 38 shown in FIG. 3. The latch 92 comprises a protrusion 94 extending from one arm and a hole 95 formed in the other arm. As shown in FIG. 9, the protrusion 94 extends downward from the first arm 46 and is configured to be inserted in the hole 95 in the second arm 48. According to this embodiment, the protrusion 94 comprises a substantially cylindrical neck 96 and a substantially spherical head 98. When the latch 92 is in a locked position, the head 98 is fully inserted in the hole 95 and restrained from being removed, by the edges of the hole 95. To release the latch 92, opposite forces are applied to the arms 46 and 48 to pull the head 98 from the hole 45.

Figure 10:
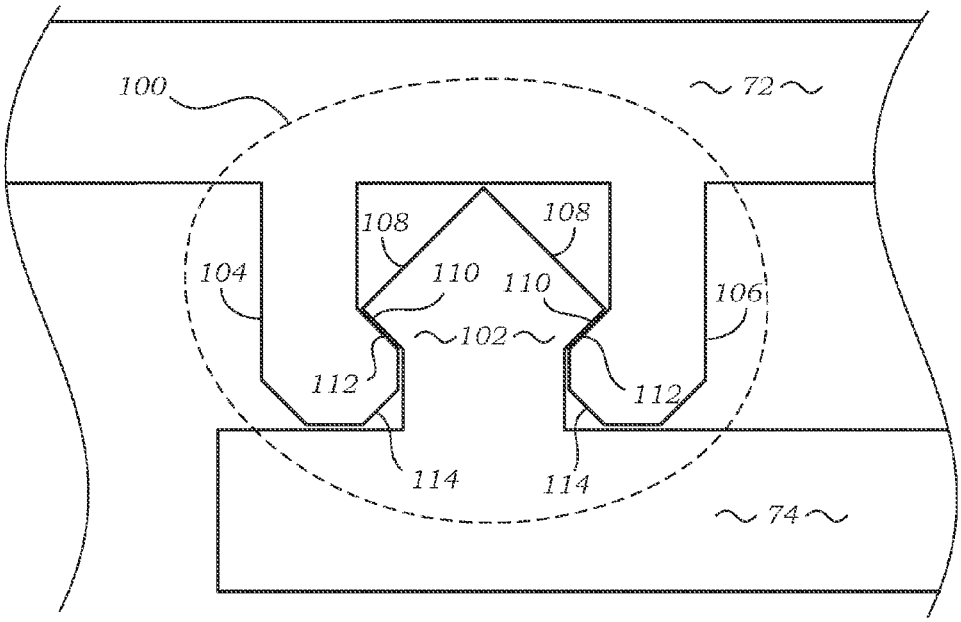
FIG. 10 is a side view of a second embodiment of a latch of the clamping assembly of FIG. 8, according to various implementations of the present disclosure.

FIG. 10 is a side view showing another embodiment of a latch 100 of the clamping assembly 70 shown in FIG. 8. According to this embodiment, the latch 100 includes a protrusion 102 that is configured to be inserted in the gap formed by a catch comprising a first hooked wall 104 and a second hooked wall 106. The protrusion 102 comprises insertion surfaces 108 allowing the protrusion 102 to be inserted into the catch and removal surfaces 110 allowing the protrusion 102 to be removed from the catch. In this embodiment, the insertion surfaces 108 of the protrusion 102 are sloped surfaces on an upper portion of the protrusion 102 and the removal surfaces 110 are sloped surface on downward-facing portions of the protrusion 102. To aid the insertion and removal of the protrusion 102, the hooked walls 104 and 106 comprise sloped removal surfaces 112 and sloped insertion surfaces 114. It should be noted that the removal surfaces 112 are also configured as locking edges to engage the protrusion 102 in a latched mode. During removal, the hooked walls 104, 106 are configured to bend outwardly to give room for the protrusion 102 to be removed. A downward force on the protrusion 102 produces an angular force from the sloped surface 110 against the sloped surface 112 to cause the hooked walls 104, 106 to separate.

Figure 11:
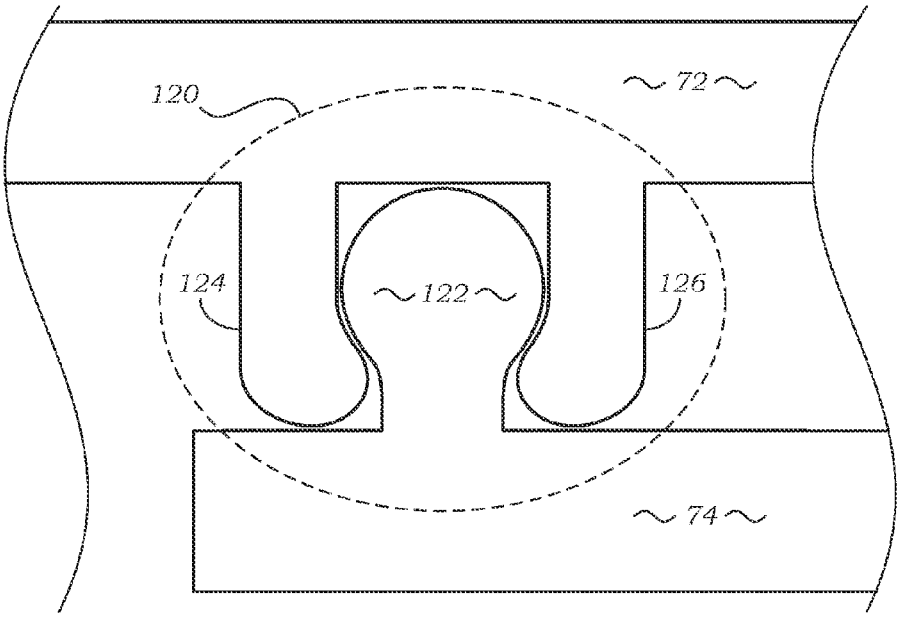
FIG. 11 is a side view of a third embodiment of a latch of the clamping assembly of FIG. 8, according to various implementations of the present disclosure.
Figure 12A:
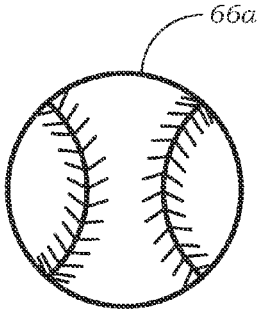
FIGS. 12A-12I are diagrams illustrating several embodiments of decorative layers that may be attached on a top surface of the shoelace knot securing device.
Figure 12B:
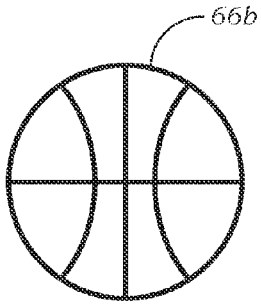
Figure 12C:
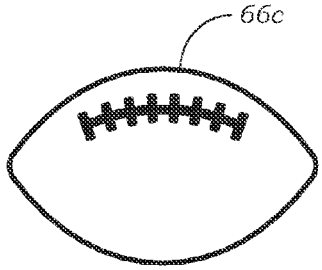
Figure 12D:
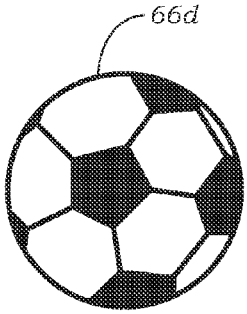
Figure 12E:
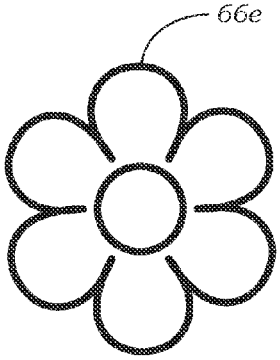
Figure 12F:
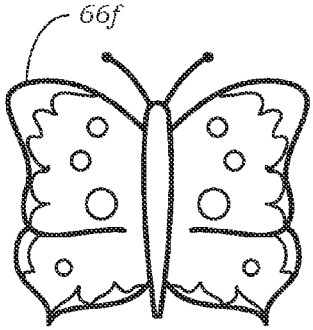
Figure 12G:
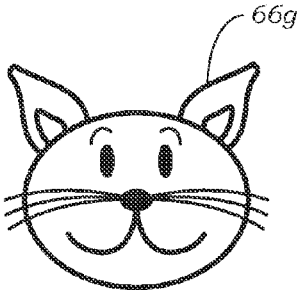
Figure 12H:
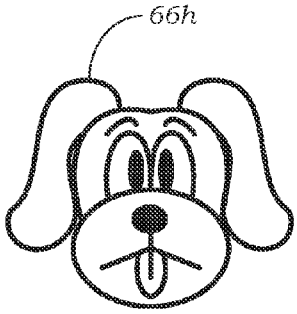
Figure 12I:
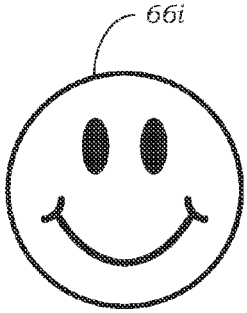

FIG. 11 is a side view showing another embodiment of a latch 120 of the clamping assembly 70 shown in FIG. 8. The latch 120 in this embodiment includes a protrusion 122 that is configured to be inserted in the gap formed by a catch comprising a first hooked support element 124 and a second hooked support element 126. The protrusion. 122 and support elements 124 and 126 include curved surfaces allowing the protrusion 122 to be inserted and/or removed from the gap between the support elements 124 and 126. Portions of the support elements 124 and 126 are configured to act as locking components to engage and hold the protrusion 122 in place when the latch 120 is in a latched mode. The surfaces of the protrusion 122 and support elements 124, 126 are configured to allow easy insertion of the protrusion 122 into the gap formed by the support elements 124, 126. The surfaces are also configured to temporarily hold the second arm 74 in a fixed position with respect to the first arm 72. Also, the surfaces are configured to allow the easy removal, of the protrusion 122 from the catch when the user wishes to unlock the latch 120.

The base plate 32, as described herein, is configured to conceal a knot of a tied shoelace, such as the shoelace 12. In some embodiments, a decorative layer, such as the decorative cap 66 as shown in FIGS. 5 and 7 may be applied to the upper surface 34 of the base plate 32. In this regard, the decorative layer may cover the knot and display a decorative pattern or image. The clamping assemblies (e.g., clamping assemblies 38 and 40 as described with respect to FIGS. 2, 3, and 5-7 or clamping assembly 70 as described with respect to FIGS. 8-9) may be arranged on the bottom surface 36 of the base plate 32.

FIGS. 12A-12I are diagrams illustrating several embodiments of decorative caps 66*a*-66*i* that may be affixed to the upper surface 34 of the base plate 32 or the top portion of the shoelace knot securing device 30. Thus, the decorative caps 66 may comprise the uppermost portion of the shoelace knot securing device 30, whereby the respective decorative cap 66 hides the functional components of the shoelace knot securing device 30 and the knot that is being secured b the shoelace knot securing device 30. The decorative caps 66 may be used as a fashionable element to display any artistic design or image. In some embodiments, one decorative cap 66 may be removed from the base plate 32 in order that another decorative cap 66 can be installed, thereby allowing interchangeability of the decorative caps 66 for the wearer. As illustrated in FIGS. 12A-12I, several examples of the decorative caps 66 are shown. The decorative caps 66 may include a ball from various sports (e.g., baseball, basketball, football, soccer, or other sport), a flower having any color(s) or design, a butterfly having any color(s) or design, animals (e.g., cat, dog, or other animal), a face (e.g., a smiley face), or any other design or image.

During a manufacturing process, base plate 32 and clamping assemblies (38, 40, 70) may be formed in one step using an injection molding technique. The functional elements of the shoelace knot securing device 30, such as the clamping elements and the latching element may he formed using a single material and color. For example, the base plate 32, clamping assemblies 38, 40, 70, protrusion 54, and latches 82, 92, 100, 120 of the various implementations may be formed using an injection molding process. The injection molding process may involve injecting a material, such as polypropylene into a mold for creating the fastening device. In some embodiments, the decorative caps 66 may be molded onto the upper surface 38 of the base plate 32 in the same molding process or in a separate step. The decorative caps 66 may comprise multiple colors and designs. According to some implementations, the decorative caps 66 may comprise one or more clip elements configured to engage with mating clip elements on the upper surface 34 of the base plate 32. In this respect, the decorative caps 66 may be clipped onto the top of the functional elements of the shoelace knot securing device 30.

It should be emphasized that the above-described embodiments are merely examples of possible implementations. Many variations and modifications may be made to the above-described embodiments without departing from the principles of the present disclosure. All such modifications and variations are intended to be included herein within the spirit and scope of the present disclosure and protected by the following claims.

I claim:

1. A fastening device configured to secure a shoelace knot, the fastening device comprising:

a base plate having the form of a circular disk and configured to visually conceal at least a portion of a knot of a tied shoelace, the base plate comprising an upper surface and a relatively flat lower surface;

a first clamping assembly attached to the base plate, the first clamping assembly comprising a first arm having a first end and a second end, the first end of the first arm attached to a first joint enabling the first arm to move with respect to the lower surface of the base plate, the first arm being moveable between an open position and a closed position, the first arm being relatively parallel with the lower surface of the base plate when in the closed position;

a second clamping assembly attached to the base plate, the second clamping assembly comprising a second arm having a first end and a second end, the first end of the second arm attached to a second joint enabling the second arm to move with respect to the lower surface of the base plate, the second arm being moveable between an open position and a closed position, the second arm being relatively parallel with the lower surface of the base plate when in the closed position;

a first latch configured to temporarily hold the first arm in the closed position, the first latch comprising a first protrusion and a first catch, the first protrusion extending from the lower surface of the base plate, the first catch comprising a first hole formed through the first arm near the second end of the first arm, an edge of the first hole being configured to releasably hold the first protrusion; and a second latch configured to temporarily hold the second arm in the closed position, the second latch comprising a second protrusion and a second catch, the second protrusion extending from the lower surface of the base plate, the second catch comprising a second hole formed through the second arm near the second end of the second arm, an edge of the second hole being configured to releasably hold the second protrusion;

wherein the first arm and the second arm are independently moveable.

2. The fastening device of claim 1, wherein the first clamping assembly and second clamping assembly are arranged on the base plate such that the first arm, when in the closed position, is substantially parallel to the second arm, when in the closed position.

3. The fastening device of claim 1, wherein the first clamping assembly further comprises a third arm and the second clamping assembly further comprises a fourth arm, the third and fourth arms being attached to the lower surface of the base plate, first joint arranged between one end of the third arm and the first end of the first arm and the second joint arranged between one end of the fourth arm and the first end of the second arm.

4. The fastening device of claim 1, wherein the first arm and second arm each comprise a textured surface on a side of the respective arm adjacent to the base plate when the respective arm is in the closed position, and wherein portions of the lower surface of the base plate adjacent to the first and second arms comprise a textured surface.

5. The fastening device of claim 4, wherein the textured surfaces of the portions of the base plate and the first and second arms comprise teeth or ridges.

6. The fastening device of claim 5, wherein the teeth or ridges of the first and second arms are offset from the teeth or ridges of the base plate.

7. The fastening device of claim 1, wherein the base plate, first clamping assembly, second clamping assembly, first latch, and second latch are formed using an injection molding process.

8. The fastening device of claim 1, wherein the base plate, first clamping assembly, second clamping assembly, first latch, and second latch comprise polypropylene.

9. The fastening device of claim 1, wherein the first arm and the second arm each have a length in the range from about 1.000 inches to about 1.250 inches and a width in the range from about 0.175 inches to about 0.250 inches.

10. The fastening device of claim 1, wherein, when the first arm and the second arm are in the closed position, a distance between the first arm and the second arm is in the range from about 0.375 inches to about 0.750 inches.

11. The fastening device of claim 1, wherein a gap between the lower surface of the base plate and each of the first arm and second arm, when in the closed position, has a dimension in the range from about 0.0625 inches to about 0.125 inches.

12. The fastening device of claim 1, further comprising a decorative layer connected to the upper surface of the base plate.

13. The fastening device of claim 1, wherein the first joint and second joint are living hinges.

14. A fastening device comprising:

a base plate having an upper surface and a relatively flat lower surface;

a first clamping assembly attached to the base plate, the first clamping assembly comprising a first arm, a first joint, and a first latch, the first arm having a first end and a second end, the first end of the first arm attached to the first joint enabling the first arm to pivot between an open position and a closed position; and a second clamping assembly attached to the base plate, the second clamping assembly comprising a second arm, a second joint, and a second latch, the second arm having a first end and a second end, the first end of the second arm attached to the second joint enabling the second arm to pivot between an open position and a closed position;

wherein the first latch is configured to temporarily hold the first arm in the closed position, the first latch comprising a first protrusion and a first catch, the first protrusion extending away from the lower surface of the base plate, the first catch comprising a locking edge formed near the second end of the first arm;

wherein the second latch is configured to temporarily hold the second arm in the closed position, the second latch comprising a second protrusion and a second catch, the second protrusion extending away from the lower surface of the base plate, the second catch comprising a locking edge formed near the second end of the second arm; and wherein the first arm and the second arm are independently moveable.

15. The fastening device of claim 14, wherein the first clamping assembly and second clamping assembly are attached to the base plate such that the first arm when in the closed position is substantially parallel to the second arm when in the closed position.

16. The fastening device of claim 14, wherein the first clamping assembly comprises a third arm attached to the lower surface of the base plate, the third arm having a first end and a second end, the first end of the third arm attached to the first joint, and wherein the second clamping assembly comprises a fourth arm attached to the lower surface of the base plate, the fourth arm having a first end and a second end, the first end of the fourth arm attached to the second joint.

17. The fastening device of claim 14, wherein the first arm and the second arm each comprise a surface having teeth or ridges.

18. The fastening device of claim 14, wherein the base plate, first clamping assembly, and second clamping assembly comprise polypropylene and are formed using an injection molding process.

19. The fastening device of claim 14, wherein the first joint and second joint are living hinges.

20. The fastening device of claim 14, wherein the lower surface of the base plate comprises a front portion and a back portion, the first joint and second joint being arranged on the back portion, and the first latch and second latch arranged on the front portion.

* * * * *